United States Patent [19]

Thörnblom et al.

[11] Patent Number: 4,638,489

[45] Date of Patent: Jan. 20, 1987

[54] METHOD AND MEANS FOR USE IN THE INSTALLATION OF PLASMA GENERATORS IN SHAFT FURNACES

[75] Inventors: Jan Thörnblom; Gunnar Astner, both of Hofors, Sweden

[73] Assignee: SKF Steel Engineering AB, Hofors, Sweden

[21] Appl. No.: 717,312

[22] Filed: Mar. 28, 1985

[30] Foreign Application Priority Data

Oct. 19, 1984 [SE] Sweden ..... 8405229

[51] Int. Cl.[4] ..... H05H 1/26

[52] U.S. Cl. ..... 373/24

[58] Field of Search ..... 373/18–25; 219/121 P, 121 PA, 121 PB, 121 PM, 121 PN, 121 PP

[56] References Cited

U.S. PATENT DOCUMENTS 3,422,206 1/1969 Baker et al. ..... 373/24

4,546,483 10/1985 Lugscheider et al. ..... 373/24

*Primary Examiner*—Roy N. Envall, Jr.

*Attorney, Agent, or Firm*—Armstrong, Nikaido, Marmelstein & Kubovcik

[57] ABSTRACT

The invention relates to a method and a means for facilitating the replacement of plasma generators and for minimizing the heat losses during installation of a plasma generator in a shaft furnace, particularly for plasma generators of the type comprising cylindrical electrodes between which an electric arc is generated, the bases of the arc being caused to rotate by means of electric field coils arranged around said electrodes. To achieve this at least the field coil (7) surrounding the electrode nearest to the nose (12) of the plasma generator, together with its connections for coolant and electricity, is permanently secured in the wall (1) of the shaft furnace in conjunction with the opening (6) for insertion of the plasma generator (11) into the shaft furnace.

15 Claims, 1 Drawing Figure

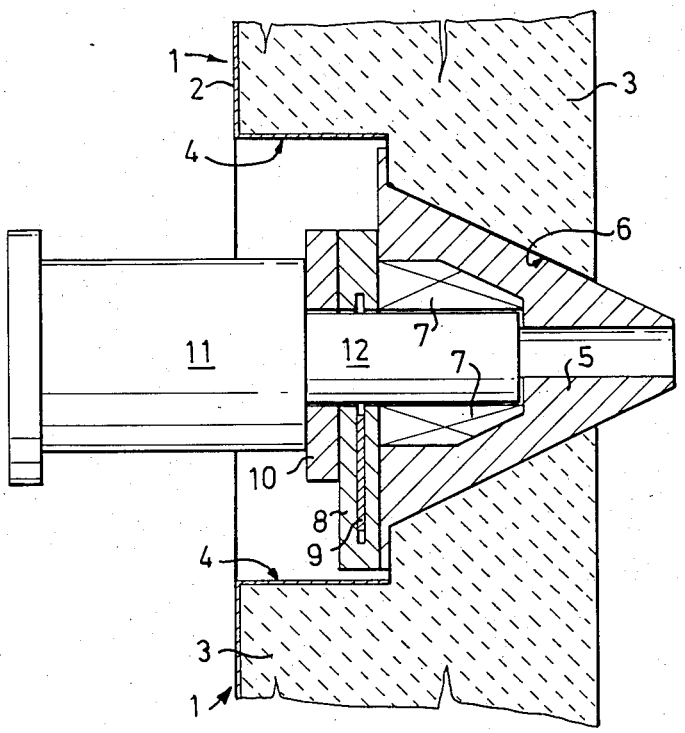
1
2
3
4
6
11
12
7
7
5
10
8
9
4
3
1

METHOD AND MEANS FOR USE IN THE INSTALLATION OF PLASMA GENERATORS IN SHAFT FURNACES

The present invention relates to a method and a means for use during the installation of plasma generators in shaft furnaces, particularly for plasma generators of the type comprising cylindrical electrodes between which an electric arc is generated, the bases of the arc being caused to rotate by means of electric field coils arranged around said electrodes.

Plasma generators can be advantageously used on an industrial scale, e.g. in metallurgical processes such as the production of metal in shaft furnaces when manufacturing synthesis gas by means of carbon gasification in the shaft, etc. Two, three or even more plasma generators are usually used simultaneously in such a process. The plasma generators must be regularly taken out of operation to change the electrodes and for general inspection and so on. Obviously, it is undesirable to discontinue operations in the shaft furnace and the plasma generator must therefore be passed through a sluice arrangement in and out of the shaft furnace.

The plasma generator with its field coils located around the electrodes, requires a considerable amount of space which means that the sluice valve must be large, entailing sealing problems and complicating its being built into the wall of the shaft furnace. The hot gas generated in the plasma generator must be conducted far into the furnace, typically to a depth of 100–300 mm inside the inner surface of the lining. The lining in shaft furnaces is normally 300–500 mm thick and if the hot gas is to reach sufficiently far into the furnace, either the recess for the sluice valve in the shaft furnace wall must be made large and deep, enabling the nose of the plasma generator to pass far in towards the interior of the furnace, or a long, water-cooled pipe must be installed in the furnace before the plasma generator to conduct the hot gas further into the furnace. Both these solutions, which may also be combined, result in considerable heat losses. Connection for the cooling water and electricity are required for both electrodes and field coils, and this entails problems since the nose of the plasma generator must be smooth to enable passage in and out of the shaft furnace through the sluice means.

The object of the present invention is thus to eliminate the drawbacks of earlier installations of plasma generators in, for instance, shaft furnaces, and to achieve a method and a means permitting simple and reliable passage of a plasma generator through sluice means while the shaft furnace is in operation.

Another object of the invention is to effect a means in the installation of plasma generators enabling a smaller valve to be used which can thus be located closer to the shaft furnace wall and facilitates insertion of the plasma generator nose sufficiently far into the shaft furnace, at the same time permitting the recess in the shaft furnace wall to be made smaller.

The above objects are achieved by the method according to the present invention, wherein at least the field coil surrounding the electrode nearest to the nose of the plasma generator, together with its connections for coolant and electricity, is permanently secured in the wall of the shaft furnace in conjunction with the opening for insertion of the plasma generator into the shaft furnace.

According to one embodiment of the invention, the part of the plasma generator secured permanently in the wall of the shaft furnace is fitted in conjunction with a buyère.

The result is that the field coil, normally surrounding the front electrode with its coolant and electricity connections, need not be passed through the sluice valve together with the plasma generator and the nose of the plasma generator can therefore be made perfectly smooth. The sluice valve can therefore be made smaller, enabling simplified insertion in the shaft wall, which in turn automatically allows the plasma generator to be passed further into the shaft furnace.

The means for use in installing a plasma generator in a shaft furnace when performing the method according to the invention includes a plasma generator having cylindrical electrodes between which an electric arc is generated, water-cooled field coils arranged around said electrodes to cause the bases of the electric arc to rotate and a sluice valve arranged in conjunction with an opening in the shaft furnace for insertion of the plasma generator, said valve permitting gastight passage of the plasma generator, wherein according to the invention the nose of the plasma generator contains the down-stream electrode and the field coil for rotation of the down-stream base of the arc in the plasma generator is permanently secured in the wall of the shaft furnace with its connections for electricity and coolant.

According to one embodiment of the means according to the invention, the field coil may be arranged in conjunction with a tuyère.

Further advantages and features of the present invention will be revealed in the following detailed description with reference to the accompanying drawing in which FIG. 1 shows schematically a cross section through an installation of a plasma generator in the wall of a shaft furnace according to the present invention.

FIG. 1 shows a part of a shaft furnace wall, generally designated 1, having an outer sheet metal casing 2 and an internal lining 3 of refractory material. A recess 4 is arranged in the shaft furnace wall 1, having an opening 6 to fit a tuyère 5. The tuyère is water cooled and protrudes a little way beyond the inside of the shaft furnace wall.

An electric field coil 7 is arranged inside the tuyère. The field coil 7 may be built as a single unit together with the tuyère 5. This offers the advantage of joint coolant supply, and also facilitates assembly and dismantling, etc.

A sluice valve 8 is arranged in front of the tuyère 5, having a valve disc 9, and in front of the sluice valve is a sealing flange 10.

The figure shows a plasma generator 11 with its nose 12 and field coil 7 inserted in the tuyère 5. The nose of the plasma generator also includes a down-stream electrode, not shown on the drawing, which is water-cooled. When the plasma generator is in its inserted, operating position, the electric field coil will surround said electrode, thus effecting the desired rotation of the lower base of the arc generated in the plasma generator.

The sealing flange 10 of the sluice valve 8 is arranged to seal against the plasma generator in operating position and during insertion and withdrawal of the plasma generator. The valve disc 9 is arranged to seal the opening in the flange when the plasma generator is fully withdrawn.

Great advantages are achieved by the ability to make the nose of the plasma generator smooth and with minimal diameter. The valve can be relatively small, thus making it considerably cheaper and more reliable. Furthermore, it can more easily be built into the shaft furnace wall, and the recess 4 in the wall surrounding the opening 6 can be made smaller. Since the valve can be placed deeper into the shaft furnace wall, the plasma generator can accordingly be inserted further in.

According to an alternative embodiment, the nose of the plasma generator replaces the water-cooling tuyère. In this case it is vital that the plasma generator can be inserted sufficiently far into the shaft furnace in order to save the lining and to achieve satisfactory gas distribution in the shaft furnace, which is achieved by utilizing the present invention.

We claim:

1. A method for installing a plasma generator in a furnace wall, comprising providing a plasma generator having electrodes for generating an electric arc therebetween and having a nose portion which comprises one of said electrodes;

providing an opening in said furnace wall for said plasma generator;

fixably mounting in said opening (1) a field coil arranged to cooperate with one of said electrodes to effect rotation of said electric arc and (2) a sealing means for effecting a gastight seal with said plasma generator; and inserting said nose portion of said plasma generator through said sealing means and into said field coil.

2. The method of claim 1, wherein at least one of said electrodes is a cylindrical electrode.

3. The method of claim 2, wherein said sealing means is a sluice valve.

4. The method of claim 1, wherein said opening in said furnace wall is fitted with a tuyere.

5. The method of claim 2, wherein said opening in said furnace wall is fitted with a tuyere.

6. The method of claim 3, wherein said opening in said furnace wall is fitted with a tuyere.

7. A plasma melting furnace arrangement comprising:

(A) a refractory lined furnace wall having an opening therein for receiving a plasma generator and, fixably mounted in said opening:

(1) a field coil arranged to cooperate with an electrode of said plasma generator to effect rotation of an electric arc and (2) a sealing means arranged to effect a gas type seal with said plasma generator; and (B) a plasma generator removably mounted in said opening of said refractory lined furnace wall and having electrodes for generating an electric arc therebetween, said plasma generator comprising a nose portion which is extendible through said sealing means and into said field coil, one of said electrodes being provided in said nose portion.

8. The plasma melting furnace arrangement of claim 7 wherein at least one of said electrodes is a cylindrical electrode.

9. The plasma melting furnace arrangement of claim 7 wherein said sealing means is a sluice valve.

10. The plasma melting furnace arrangement of claim 7 further comprising a tuyere fixably mounted in said opening and arranged in conjunction with said field coil.

11. The plasma melting furnace arrangement of claim 8 further comprising a tuyere fixably mounted in said opening and arranged in conjunction with said field coil.

12. The plasma melting furnace arrangement of claim 9 further comprising a tuyere fixably mounted in said opening and arranged in conjunction with said field coil.

13. The plasma melting furnace arrangement of claim 10 wherein said field coil is arranged within said tuyere to form a single unit.

14. The plasma melting furnace arrangement of claim 11 wherein said field coil is arranged within said tuyere to form a single unit.

15. The plasma melting furnace arrangement of claim 12 wherein said field coil is arranged within said tuyere to form a single unit.

* * * * *